US006928740B1

(12) United States Patent
Yeh

(10) Patent No.: US 6,928,740 B1
(45) Date of Patent: Aug. 16, 2005

(54) BUFFERING MEMBER FOR SCISSORS

(76) Inventor: Wen-Ya Yeh, No. 27, Kaisyuan Road, Tainan (TW)

( * ) Notice: Subject to any disclaimer, the term of this patent is extended or adjusted under 35 U.S.C. 154(b) by 5 days.

(21) Appl. No.: 10/775,317

(22) Filed: Feb. 10, 2004

(51) Int. Cl.[7] ..... B26B 13/20
(52) U.S. Cl. ..... 30/271; 30/254; 30/232
(58) Field of Search ..... 30/231, 232, 254, 30/271, 341; D8/57

(56) References Cited

U.S. PATENT DOCUMENTS

| | | | | |
|---|---|---|---|---|
| 1,623,130 | A * | 4/1927 | Otis | 30/349 |
| 4,254,551 | A * | 3/1981 | Megna et al. | 30/341 |
| 5,109,608 | A * | 5/1992 | Pracht | 30/341 |
| D385,174 | S * | 10/1997 | Kawai | D8/107 |
| 6,665,939 | B1 * | 12/2003 | Adachi | 30/232 |
| 2002/0129497 | A1 * | 9/2002 | Lyddon et al. | 30/232 |
| 2005/0005456 | A1 * | 1/2005 | Wang et al. | 30/232 |

* cited by examiner

*Primary Examiner*—Hwei-Siu Payer
(74) *Attorney, Agent, or Firm*—Alan D. Kamrath; Nikolai & Mersereau, P.A.

(57) ABSTRACT

A pair of scissors includes a first handle having a ring portion, a second handle having a ring portion, and a buffering member. One of the ring portion of the first handle and the ring portion of the second portion has a radial hole. The buffering member includes a body and a buffering element. The body includes an engaging portion securely engaged in the radial hole without extending into a space delimited by the ring portion having the radial hole. The buffering element includes a first end securely attached to the body and a second end between the ring portions. The ring portions are spaced apart from each other by the buffering element when the first handle and the second handle are moved toward each other, preventing the ring portions from bumping against each other.

8 Claims, 7 Drawing Sheets

BUFFERING MEMBER FOR SCISSORS

BACKGROUND OF THE INVENTION

1. Field of the Invention

The present invention relates to a buffering member for a pair of scissors. In particular, the present invention relates to a buffering member preventing the ring portions of two handles of a pair of scissors from bumping against each other while avoiding discomfort to the fingers of the user.

2. Description of the Related Art

FIGS. 6 and 7 of the drawings illustrate a pair of conventional scissors 1 including a first handle 2 and a second handle 4. The first handle 2 includes a ring portion 3, and the second handle 4 includes a ring portion 5 having a radial through-hole 13. A buffering member 14 made of rubber includes a necked portion 15 engaged in the through-hole 13 of the ring portion 5, a distal portion 16 inside the ring portion 5, and a buffering portion 17 outside the ring portion 5. As illustrated in FIG. 7, when the handles 2 and 4 are moved toward each other, the ring portions 3 and 5 would not bump against each other to prevent generation of "click", as the ring portions 3 and 5 are spaced apart from each other by the buffering portion 17 of the buffering member 14. The distal portion 16 of the buffering member 14 is forcibly inserted through the through-hole 13 into the ring portion 5. Nevertheless, when the buffering member 14 is made of rigid rubber, noise is still generated when the buffering portion 17 of the buffering member 14 bumps against the ring portion 3. On the other hand, when the buffering member 14 is made of soft rubber, the neck portion 15 and/or the distal portion 16 might be damaged or even broken during insertion of the distal portion 16. Further, the distal portion 16 of the buffering member 14 causes discomfort to the user's finger during use of the pair of scissors regardless of the material of the buffering member 14. Operation of the scissors is adversely affected.

SUMMARY OF THE INVENTION

In accordance with an aspect of the invention, a pair of scissors in accordance with the present invention includes a first handle having a ring portion, a second handle having a ring portion, and a buffering member. One of the ring portion of the first handle and the ring portion of the second portion has a radial hole.

The buffering member includes a body and a buffering element. The body includes an engaging portion securely engaged in the radial hole without extending into a space delimited by the ring portion having the radial hole. The buffering element includes a first end securely attached to the body and a second end between the ring portions. The ring portions are spaced apart from each other by the buffering element when the first handle and the second handle are moved toward each other, preventing the ring portions from bumping against each other.

In an embodiment of the invention, the buffering element is made of soft rubber. The engaging portion of the body is a threaded portion, and the radial hole is a screw hole for threadedly engaging with the threaded portion. The body includes a compartment for securely receiving the first end of the buffering element. A peripheral wall delimiting the compartment includes an annular groove, and the first end of the buffering element includes an annular flange securely received in the annular groove.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
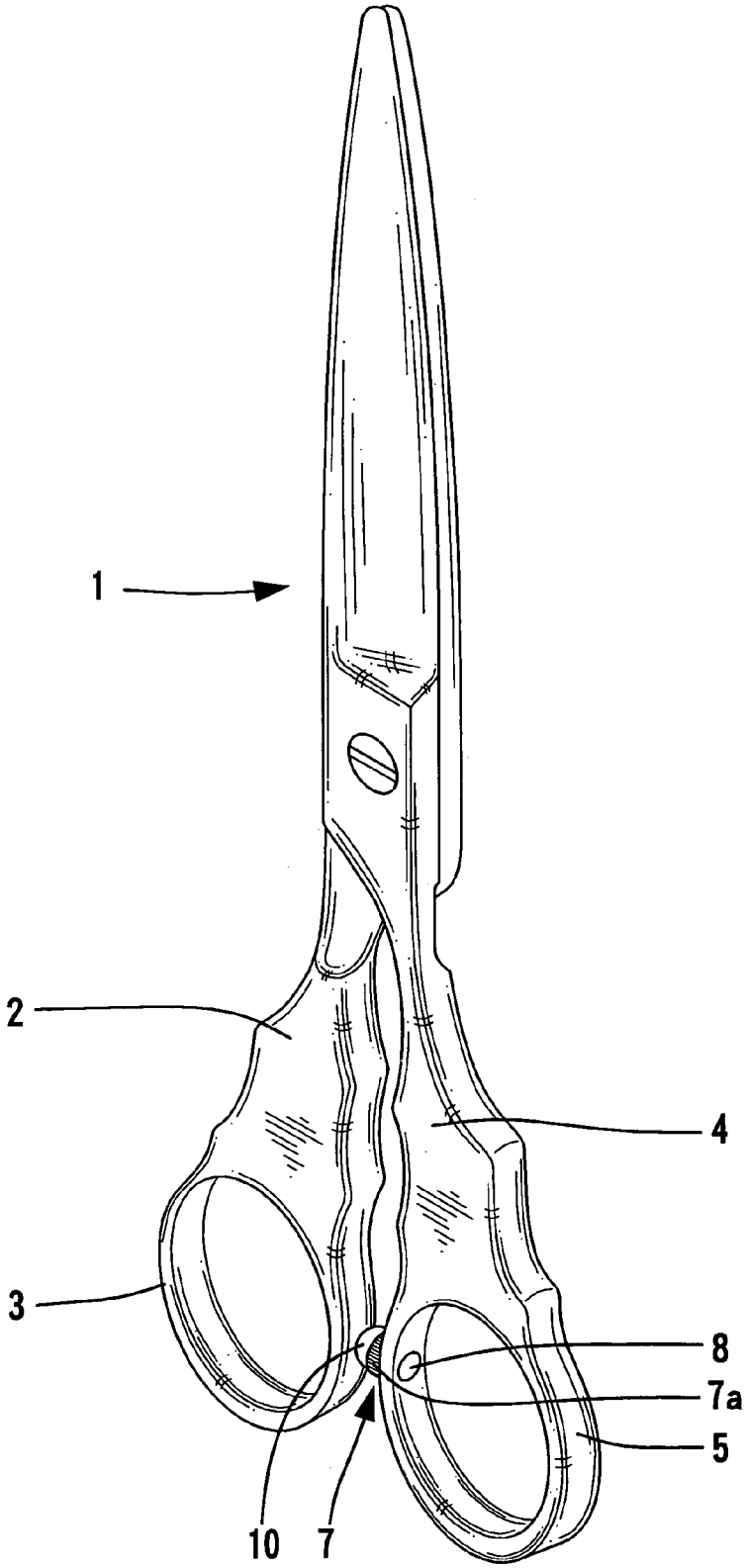
FIG. 1 is a perspective view of a pair of scissors in accordance with the present invention.
Figure 2:
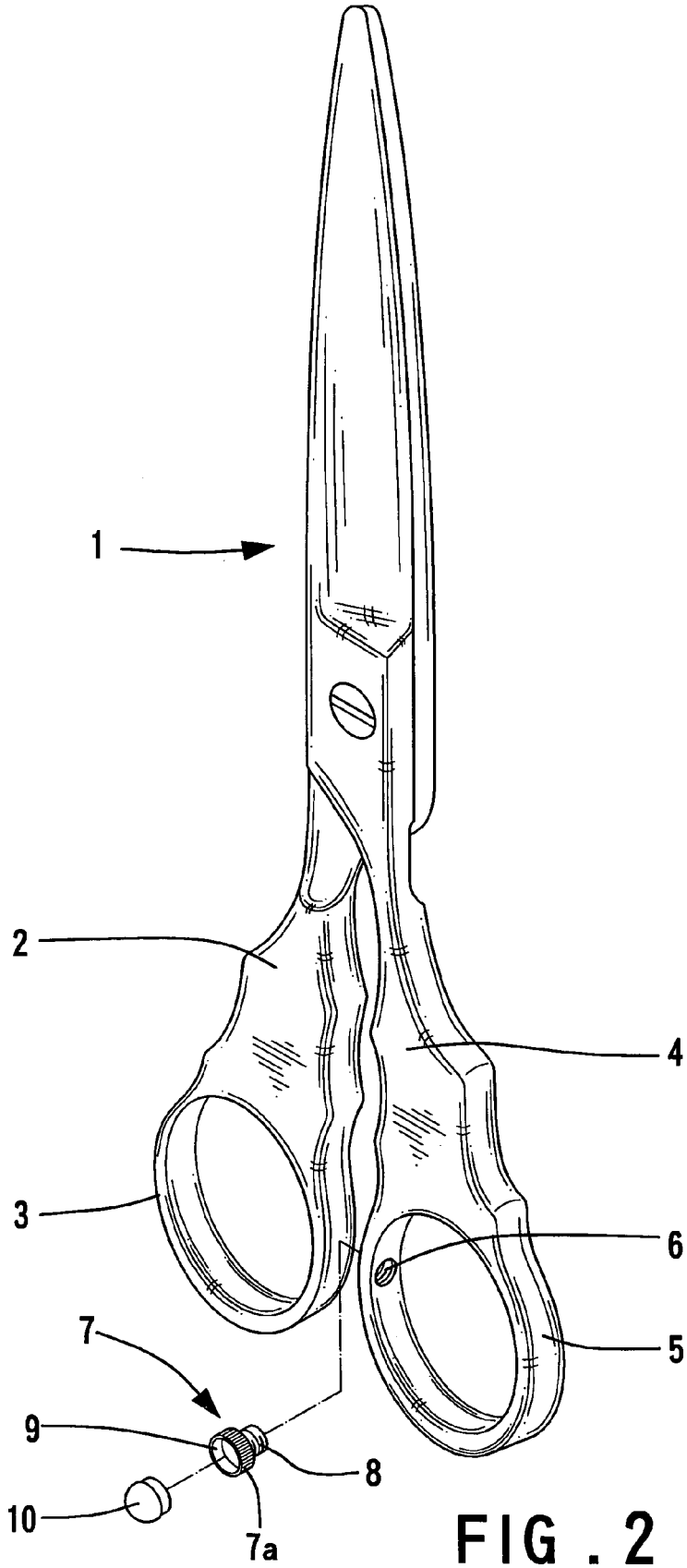
FIG. 2 is a perspective view, partly exploded, of the pair of scissors in accordance with the present invention.
Figure 3:
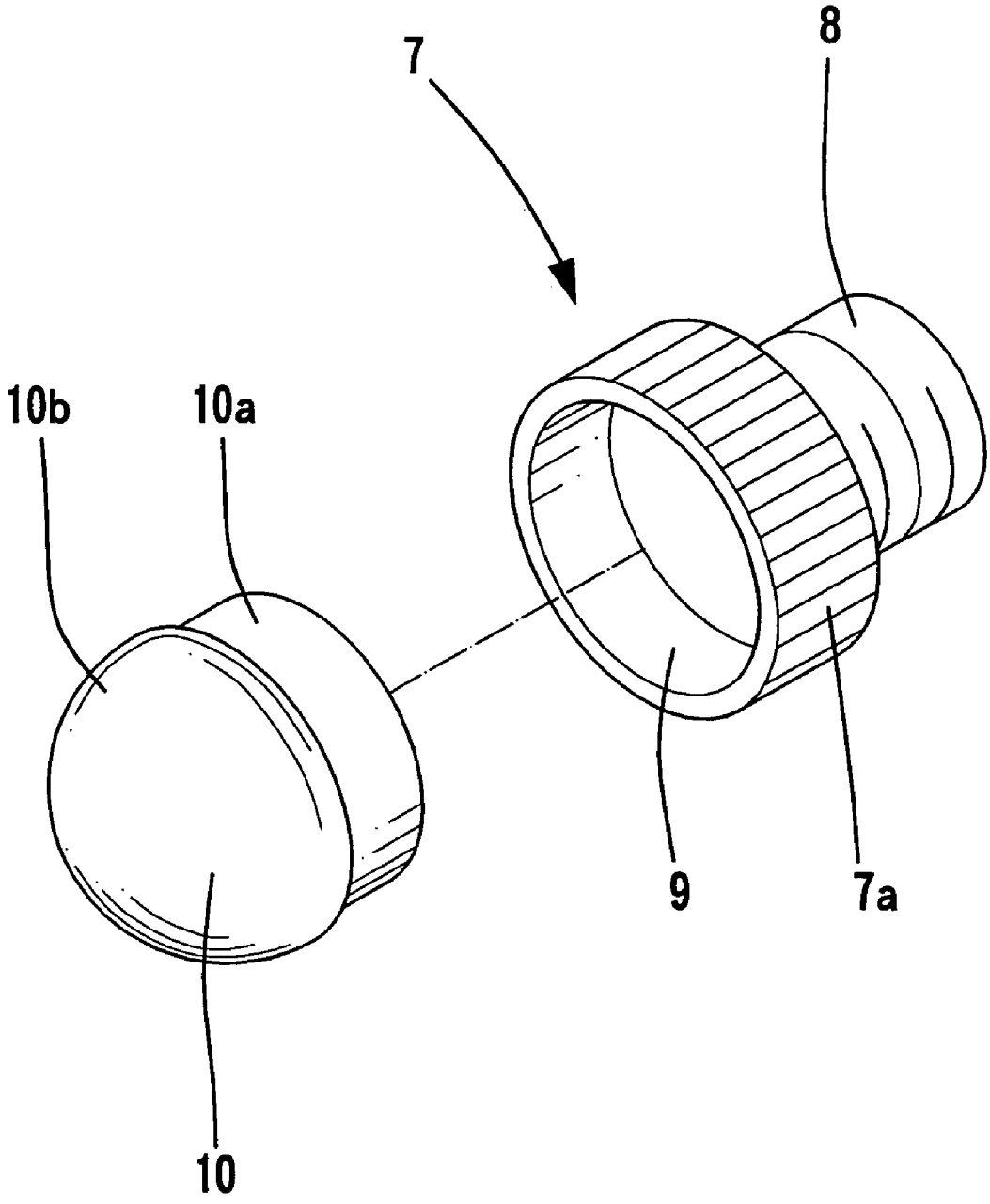
FIG. 3 is an enlarged exploded perspective view of a buffering member of the pair of scissors in accordance with the present invention.

Referring to FIGS. 1 through 4, a pair of scissors 1 in accordance with the present invention generally comprises a first handle 2 and a second handle 4. The first handle 2 includes a ring portion 3, and the second handle 4 includes a ring portion 5 having a radial screw hole 6. A buffering member 7 is attached to the ring portion 5. The buffering member 7 includes a body 7*a* and a buffering element 10. The body 7*a* includes a compartment 9 for securely receiving an end 10*a* of the buffering element 10 made of soft rubber and an engaging portion. In this embodiment, the engaging portion is in the form of a threaded portion 8.

Figure 4:
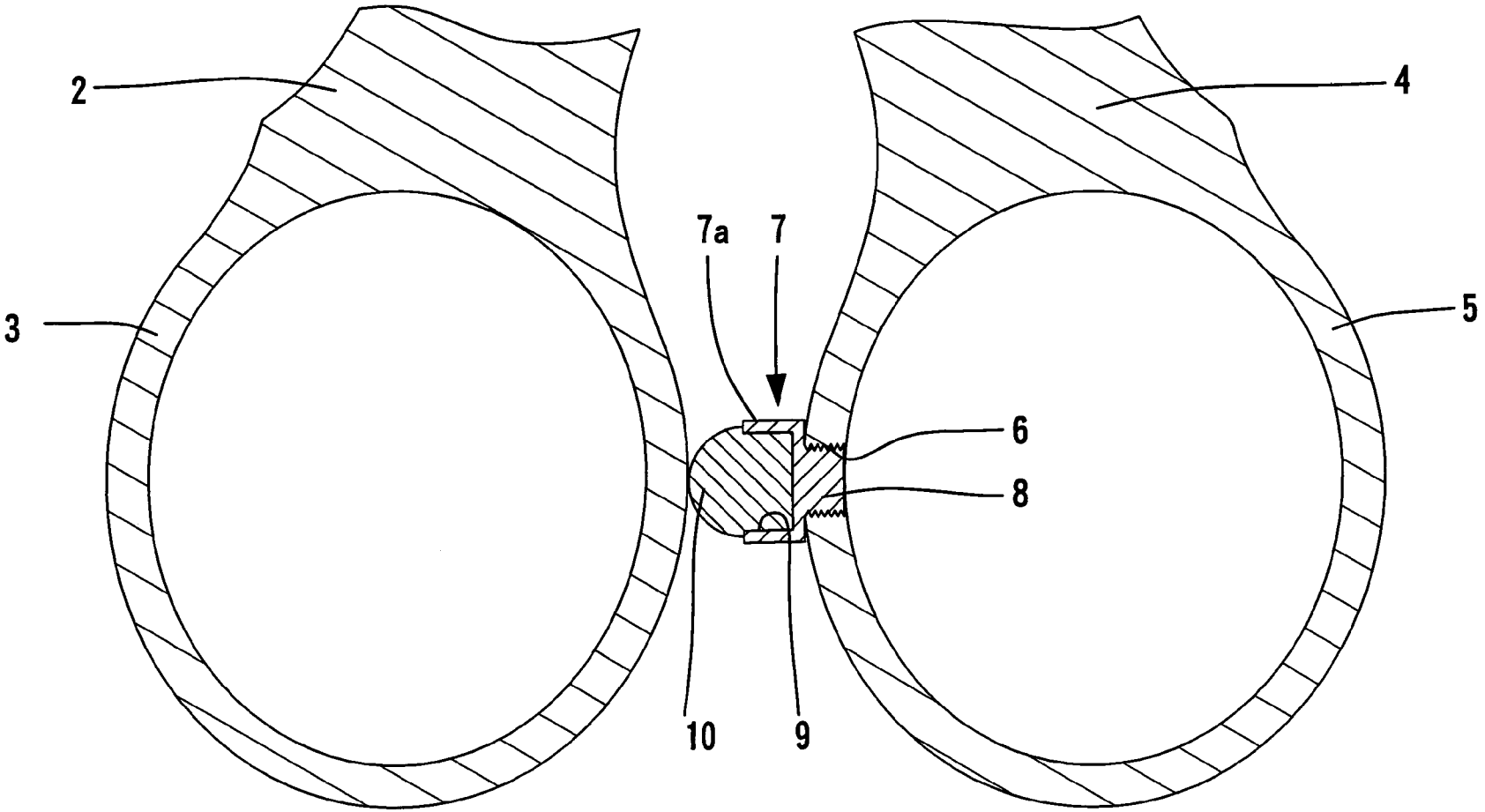
FIG. 4 is a sectional view of a portion of the pair of scissors in accordance with the present invention.

As illustrated in FIG. 4, the buffering member 7 can be easily attached to the ring portion 5 by means of engaging the threaded portion 8 of the buffering member 7 with the radial screw hole 6 of the ring portion 5. The threaded portion 8 of the buffering member 7 is inside the radial screw hole 6 of the ring portion 5, not in the space delimited by the ring portion 5. Thus, discomfort to the user's finger is not caused, and interference to the operation of the pair of scissors 1 is avoided. The body 7*a* of the buffering member 7 may include an embossed outer periphery, allowing easy grasp by the user's fingers while engaging the threaded portion 8 into the radial screw hole 6.

Still referring to FIG. 4, when the handles 2 and 4 are moved toward each other to a closed position, the ring portions 3 and 5 would not bump against each other, as the ring portions 3 and 5 are spaced apart from each other by the other end 10*b* of the buffering element 10 therebetween. The buffering element 10 is made of soft rubber and thus would not generate sound when the other end 10*b* of the buffering element 10 and the ring portion 3 bump against each other.

Figure 5:
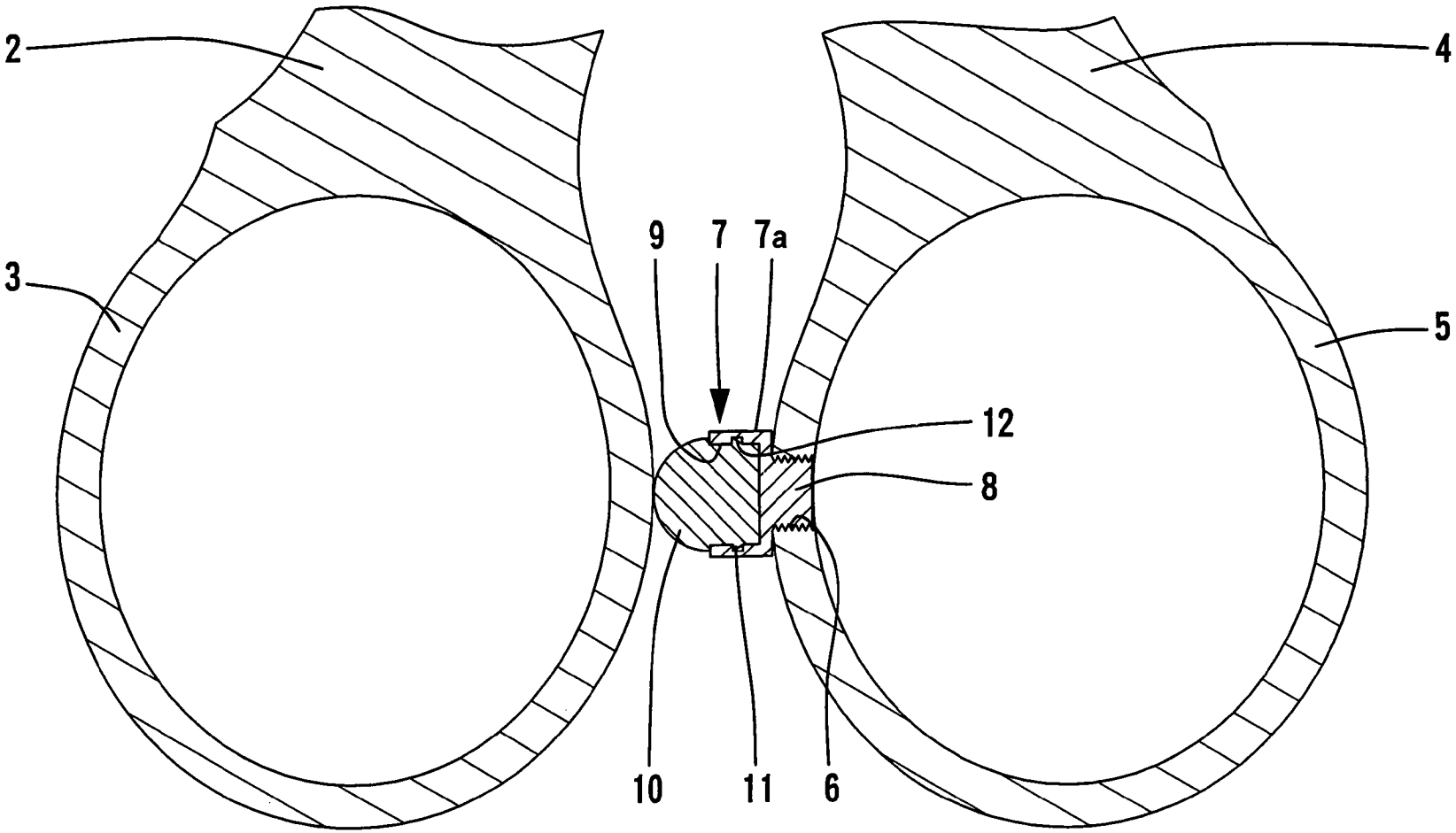
FIG. 5 is a sectional view similar to FIG. 4, illustrating a modified embodiment of the buffering member in accordance with the present invention.
Figure 6:
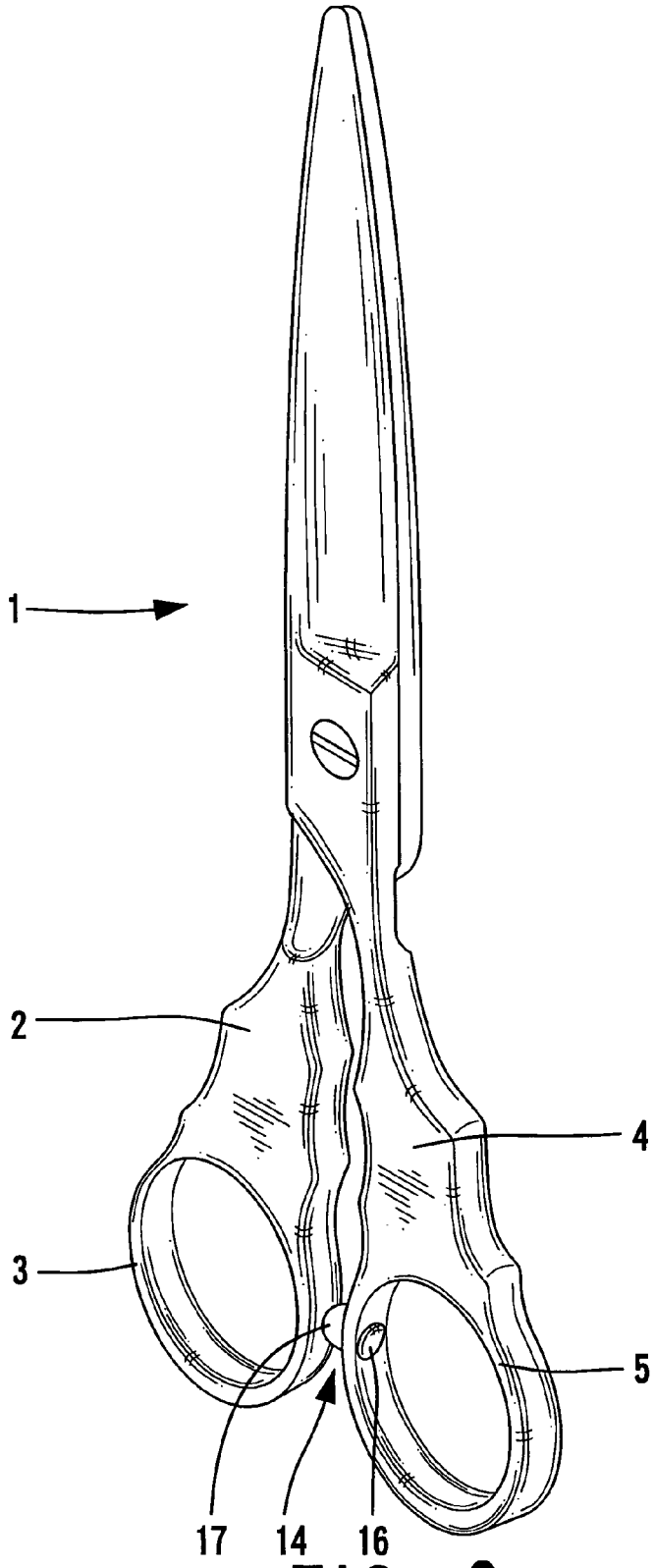
FIG. 6 PRIOR ART
FIG. 6 is a perspective view of a pair of conventional scissors.
Figure 7:
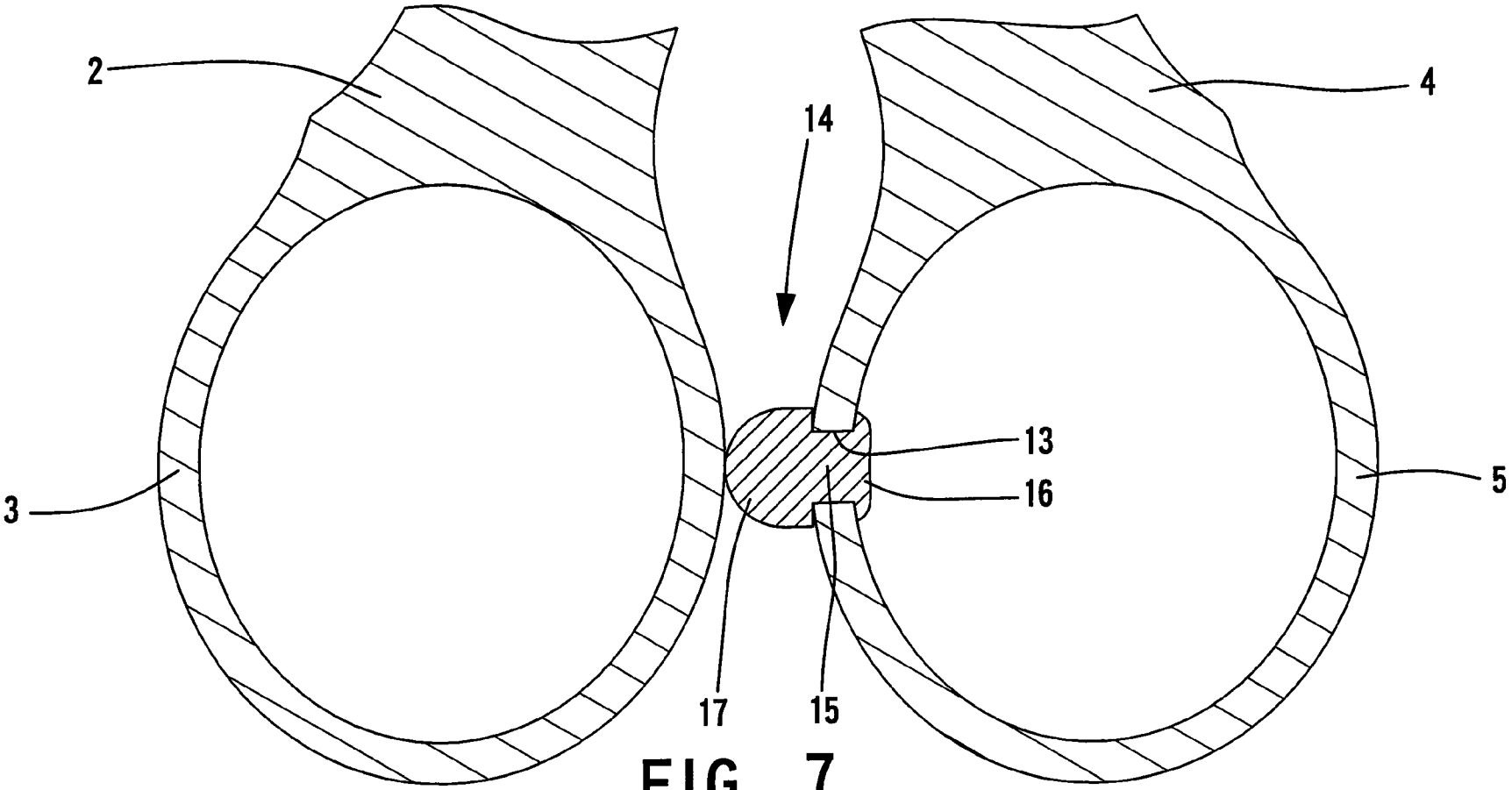
FIG. 7 PRIOR ART
FIG. 7 is a sectional view of a portion of the pair of conventional scissors.

FIG. 5 illustrates a modified embodiment of the buffering member 7, wherein a peripheral wall delimiting the compartment 9 includes an annular groove 12, and the end 10*a* of the buffering element 10 includes an annular flange 11 securely mounted in the annular groove 12.

Although not specifically illustrated, it is noted that the end 10*a* of the buffering element 10 may an annular groove in an outer periphery thereof, and the peripheral wall delimiting the compartment 9 may include an annular flange received in the annular groove of the buffering element 10.

The screw hole 6 of the ring portion 5 and the threaded portion 8 of the buffering member 7 may be replaced with other equivalent arrangements. For example, the ring portion 5 may include a hole configured for removably or fixedly receiving a correspondingly shaped portion on the buffering member 7.

Although the invention has been explained in relation to its preferred embodiment, it is to be understood that many other possible modifications and variations can be made without departing from the scope of the invention as hereinafter claimed.

What is claimed is:

1. A pair of scissors comprising:

a first handle having a ring portion;

a second handle having a ring portion, one of the ring handle of the first handle and the ring portion of the second portion including a radial hole; and a buffering member including a body and a buffering element, the body including an engaging portion securely engaged in the radial hole without extending into a space delimited by the ring portion having the radial hole, the buffering element including a first end securely attached to the body and a second end between the ring portions, the ring portions being spaced apart from each other by the buffering element when the first handle and the second handle are moved toward each other, preventing the ring portions from bumping against each other.

2. The pair of scissors as claimed in claim 1, wherein the buffering element is made of soft rubber.

3. The pair of scissors as claimed in claim 1, wherein the engaging portion of the body is a threaded portion, and wherein the radial hole is a screw hole for threadedly engaging with the threaded portion.

4. The pair of scissors as claimed in claim 1, wherein the body includes a compartment for securely receiving the first end of the buffering element.

5. The pair of scissors as claimed in claim 4, wherein a peripheral wall delimiting the compartment includes an annular groove, and wherein the first end of the buffering element includes an annular flange securely received in the annular groove.

6. The pair of scissors as claimed in claim 3, wherein the buffering element is made of soft rubber.

7. The pair of scissors as claimed in claim 4, wherein the buffering element is made of soft rubber.

8. The pair of scissors as claimed in claim 5, wherein the buffering element is made of soft rubber.

* * * * *